US006422565B1

(12) United States Patent
Daines

(10) Patent No.: US 6,422,565 B1
(45) Date of Patent: Jul. 23, 2002

(54) BLACKJACK-STYLE CARD GAME METHOD

(75) Inventor: Shirley Daines, Red Deer (CA)

(73) Assignee: Canadian (21) Stook Ltd., Red Deer (CA)

( * ) Notice: Subject to any disclaimer, the term of this patent is extended or adjusted under 35 U.S.C. 154(b) by 0 days.

(21) Appl. No.: 09/681,636

(22) Filed: May 14, 2001

(30) Foreign Application Priority Data

Apr. 18, 2001 (CA) ..... 2344296

(51) Int. Cl.[7] ..... A63F 1/00

(52) U.S. Cl. ..... 273/292; 273/138 A; 273/303; 273/139; 463/12; 463/13

(58) Field of Search ..... 273/292, 274, 273/139, 303

(56) References Cited

U.S. PATENT DOCUMENTS 3,796,433 A * 3/1974 Fraley et al. ..... 273/138 A
5,154,429 A * 10/1992 LeVasseur ..... 273/292
5,257,789 A * 11/1993 LeVasseur ..... 273/292
5,320,356 A * 6/1994 Cauda ..... 273/292
5,407,209 A * 4/1995 Prerost ..... 273/292
5,603,499 A * 2/1997 Jagosz ..... 273/148 R
5,673,917 A * 10/1997 Vancura ..... 273/292
5,799,946 A * 9/1998 Groussman ..... 273/292
5,823,536 A * 10/1998 Flasch ..... 273/292
RE35,968 E * 11/1998 Prerost ..... 273/292
5,934,675 A * 8/1999 Handelman et al. ..... 273/292
6,000,699 A * 12/1999 Long ..... 273/292
6,170,828 B1 * 1/2001 Mostashari ..... 273/292

OTHER PUBLICATIONS

Scarne's Encyclopedia of Games, John Scarne, Harper & Row, 1973—pp. 277–290.*

* cited by examiner

*Primary Examiner*—Benjamin H. Layno
*Assistant Examiner*—Dolores R. Collins

(57) ABSTRACT

A blackjack-style card game method includes the step of requiring the dealer to continue dealing cards to the dealer's hand until the dealer's hand exceeds the players hand or exceeds 21.

6 Claims, No Drawings

BLACKJACK-STYLE CARD GAME METHOD

BACKGROUND OF INVENTION

The present invention relates to a method of playing a blackjack-style card game in a casino environment.

In conventional blackjack, the player may stand at any point value and the dealer must continue to deal cards to the dealer's hand if the point value is 16 or less and the dealer must stand at 17 or more. In addition, if the player's hand and the dealer's hand have the same value, the hand is a "push" and no winner is determined. If a player receives an ace and a face card or a 10, that is considered a blackjack and pays 1.5:1 immediately, without seeing the dealer's hand. It may be desirable to have a method of playing a blackjack style card game which does not feature a "push" or a tie between the player and the dealer.

SUMMARY OF INVENTION

In one aspect, the invention comprises a method of playing a game of cards between a dealer and a player, comprising the steps of: (a) providing at least one standard deck of cards; (b) allowing the player to place a bet; (c) dealing two cards face up to the player and one card face up to the dealer; (d) paying the player's bet if the player's two cards are a blackjack; (e) dealing additional cards to the player, at the player's option, until the player does not want any more cards or until the player's hand exceeds 21; (f) collecting the player's bet if the player's hand exceeds 21; (g) after the player stands, dealing additional cards to the dealer until the dealer's hand either exceeds the player's hand or exceeds 21; and (h) collecting the player's bet if the dealer exceeds the player's hand but not 21; or paying the player's bet if the dealer exceeds 21.

In another aspect, the invention comprises an improvement to the standard casino game of blackjack. In a method of playing a blackjack-style card game between a player and a dealer, wherein the object is to achieve a hand of cards which is close to or equal to 21 without exceeding 21, wherein cards are dealt to the player until the player stands or busts and cards are dealt to the dealer after the player stands, the winner being determined by the summed point value of the cards, the improvement comprising the step of requiring the dealer to continue dealing cards to the dealer's hand until either the dealer's hand exceeds the player's hand or the dealer busts.

DETAILED DESCRIPTION

When describing the present invention, all terms not defined herein have their common art-recognized meanings. The term "live casino game" is intended to encompass a game in which the house acts as the banker, the house collecting all losing wagers and paying all winning wagers. The dealer is employed by the house and each player plays exclusively against the house.

The method of the present invention is intended to be practiced in a casino or gaming house environment where players may wager against the house, but may not be restricted to such an environment. The basic object of the game is to achieve a hand of cards close to or equal to 21 without exceeding 21. If a hand exceeds 21, the player or dealer is said to have "bust". As is conventionally the case, numerical cards are valued at their face value, face cards count as 10 and aces count as 1 or 11 points.

The dealer plays against each player one at a time. If there are more than one player, they must take turns playing. Play begins with the player making a bet. The dealer then deals two cards face up to the player and card face up for the dealer.

If the player has a suited blackjack, which is an ace and a face card or a 10 of the same suit, the player automatically wins and the hand is finished. The player bet is paid at 2:1 for a blackjack.

If the player has two cards of the same point value, the player may split them and play two separate hands. In that case, the dealer will deal an additional up card for each of the two player hands and the player may play each hand in order. If the next card is again identical point value, then the player may split again and play three separate hands. Resplitting is permitted an unlimited number of times. Aces may be resplit an unlimited number of times and a player may draw to split aces.

If the player wishes, he or she may double the bet after receiving the player's initial two cards, or a second card if the first two cards have been split, and seeing the dealer's first card. If a player doubles down, the player may then take only one additional card. In an alternative embodiment, the player may be permitted to take two or more cards after doubling down.

A player may continue to split and double down in any combination the cards permit. In each case, after the player has finished splitting or doubling, the player may request additional cards in conventional fashion. The dealer will continue to deal cards to the player until the player busts or stands. If the player reaches 21, it is an automatic winner and is paid 1:1 immediately. If the player busts, the player loses his bet. After the player stands, the dealer begins to deal cards to the dealer's hand. The dealer must continue dealing to the dealer's hand until either the dealer's hand exceeds the player's hand or until the dealer busts. If the dealer's hand and the player's hand are equal, the dealer must take an additional card. If the dealer's hand exceeds the player's hand but has not bust, then the player's bet is lost. If the dealer busts, the player wins and is paid at 1:1.

As is apparent to one skilled in the art, the methods disclosed herein may be implemented at a live table game or electronically in an electronic video type gaming device, of the same general type disclosed in U.S. Pat. Nos. 4,948,134; 5,022,653; 5,377,973; 5,374,067; and 5,382,025. In the electronic version, the hand(s) of the player(s) and dealer take the form of video representations of playing cards displayed on a screen, under the control of a microprocessor operating under a suitable program.

As will be apparent to those skilled in the art, various modifications, adaptations and variations of the foregoing specific disclosure can be made without departing from the scope of the invention claimed herein.

I claim:

1. A method of playing a game of cards between a dealer and a player, comprising the steps of:

(a) providing at least one standard deck of cards;

(b) allowing the player to place a bet;

(c) dealing two cards face up to the player and one card face up to the dealer;

(d) paying the player's bet if the player's two cards are a blackjack;

(e) dealing additional cards to the player, at the player's option, until the player does not want any more cards or until the player's hand exceeds 21;

(f) collecting the player's bet if the player's hand exceeds 21;

(g) after the player stands, dealing additional cards to the dealer until the dealer's hand either exceeds the player's hand or exceeds 21; and (h) collecting the player's bet if the dealer exceeds the player's hand but not 21; or paying the player's bet if the dealer exceeds 21.

2. The method of claim 1 further comprising the step of allowing the player to split two cards which have the same point value and playing separate hands.

3. The method of claim 1 further comprising the step of allowing the player to double the player's bet after receiving the players two initial cards.

4. The method of claim 1 wherein the player's bet pays 2:1 for a suited blackjack.

5. The method of claim 1 wherein the player's bet pays 1:1 if the dealer's hand exceeds 21.

6. In a method of playing a blackjack-style card game between a player and a dealer, wherein the object is to achieve a hand of cards which is close to or equal to 21 without exceeding 21, wherein cards are dealt to the player until the player stands or busts and cards are dealt to the dealer after the player stands, the winner being determined by the summed point value of the cards, the improvement comprising the step of requiring the dealer to continue dealing cards to the dealer's hand until either the dealer's hand exceeds the player's hand or the dealer busts.

* * * * *